US011302499B1

(12) United States Patent
Smith et al.

(10) Patent No.: US 11,302,499 B1
(45) Date of Patent: Apr. 12, 2022

(54) VACUUM CIRCUIT BREAKER

(71) Applicant: MITSUBISHI ELECTRIC POWER PRODUCTS, INC., Warrendale, PA (US)

(72) Inventors: Zachary A. Smith, Seven Fields, PA (US); Paul J. Vladuchick, Cranberry Township, PA (US)

(73) Assignee: MITSUBISHI ELECTRIC POWER PRODUCTS, INC., Warrendale, PA (US)

( * ) Notice: Subject to any disclaimer, the term of this patent is extended or adjusted under 35 U.S.C. 154(b) by 0 days.

(21) Appl. No.: 17/064,741

(22) Filed: Oct. 7, 2020

(51) Int. Cl.

| | |
|---|---|
| ***H01H 33/04*** | (2006.01) |
| ***H01H 33/59*** | (2006.01) |
| ***H01H 33/664*** | (2006.01) |
| ***H01H 33/662*** | (2006.01) |

(52) U.S. Cl.
CPC ..... *H01H 33/04* (2013.01); *H01H 33/59* (2013.01); *H01H 33/664* (2013.01); *H01H 33/66207* (2013.01)

(58) Field of Classification Search
CPC ..... H01H 33/04; H01H 33/59; H01H 33/122; H01H 33/66207; H01H 33/664; H01H 33/56; H01H 33/561; H01H 2033/6665; H01H 2033/566; H01H 9/54; H01H 33/6661; H01H 33/143; H01H 9/547; H01H 2009/546
USPC ... 218/139, 134, 138, 143, 146, 152, 79, 80, 218/97, 115, 119
See application file for complete search history.

(56) References Cited

U.S. PATENT DOCUMENTS 3,469,048 A 9/1969 Lee et al.
3,813,506 A * 5/1974 Mitchell ..... H01H 33/14 218/4
3,814,885 A * 6/1974 Sofianek ..... H01H 33/668 218/122

(Continued)

FOREIGN PATENT DOCUMENTS

CN 1728312 A 2/2006
CN 102683100 B 8/2014

(Continued)

OTHER PUBLICATIONS

Translation of EP0737993 (Original document published Oct. 16, 1996) (Year: 1996).*

*Primary Examiner* — William A Bolton
(74) *Attorney, Agent, or Firm* — One LLP

(57) ABSTRACT

Disclosed are example embodiments of a dead tank circuit breaker for protecting electrical components against electrical surges and other voltage anomalies such as transient overvoltages. The circuit breaker includes: one or more vacuum interrupters; a current bypass circuit electrically coupled to the one or more vacuum interrupters; a dead tank encasing and hermetically sealing the one or more vacuum interrupters and the current bypass circuit, wherein the dead tank is pressurized with a non-SF6 gas; and a controllable mechanism coupled to the one or more vacuum interrupters and to the current bypass circuit. The controllable mechanism is configured to actuate the one or more vacuum interrupters and the current bypass circuit to open or close a main circuit path such that any pre-strike arcing occurs on the current bypass circuit instead of the one or more vacuum interrupters.

15 Claims, 6 Drawing Sheets

(56) References Cited

U.S. PATENT DOCUMENTS

| | | | | |
|---|---|---|---|---|
| 3,983,345 | A * | 9/1976 | Phillips | H01H 33/668 218/122 |
| 4,027,123 | A * | 5/1977 | Ihara | H01H 33/14 218/4 |
| 4,492,835 | A * | 1/1985 | Turner | H01H 33/6661 218/144 |
| 5,347,096 | A | 9/1994 | Bolongeat-Mobleu et al. | |
| 6,838,631 | B2 | 1/2005 | Munakata et al. | |
| 8,168,909 | B2 | 5/2012 | Kobayashi et al. | |
| 8,847,095 | B2 * | 9/2014 | Donzel | H01H 33/14 218/7 |
| 9,196,439 | B2 | 11/2015 | Gentsch | |
| 2017/0352508 | A1 | 12/2017 | Chung et al. | |

FOREIGN PATENT DOCUMENTS

| | | | | |
|---|---|---|---|---|
| EP | 0737993 | * | 10/1996 | H01H 33/64 |
| EP | 2722859 B1 | | 4/2016 | |

* cited by examiner

VACUUM CIRCUIT BREAKER

FIELD

The disclosure relates generally to the field of circuit breakers, specifically and not by way of limitation, some embodiments are related to a vacuum gas circuit breaker.

BACKGROUND

Circuit breakers are essential components to provide safety and to protect power components connected to high-voltage transmission lines. Circuit breakers are designed to reliably break the circuit in abnormal operating conditions such as a power surge (e.g., lightning), short line fault, and abnormal voltage impulses. In the event of a fault, circuit breakers are designed to rapidly break the short-circuiting currents. The main components of a dead tank circuit breaker are vacuum chamber, actuating assembly to actuate one of the electrodes, and a pressurized dead tank encasing the vacuum chamber. Disconnection and connection of the current is accomplished by engaging the electrodes inside of the vacuum chamber. Typically, one of the electrodes is movable and the other is fixed. The movable electrode is brought into contact with or disconnected from the stationary electrode using the actuating assembly. To prevent arcing during actuation or in other fault scenarios (e.g., lightning), the electrodes are housed in a vacuum, which in turn is encapsulated in a grounded dead tank. To further improve the dielectric withstand of the circuit breaker, the dead tank is sized as large as possible and is typically filled with an arc quenching medium such as sulfur hexafluoride (SF6) gas.

SF6 gas is widely used in high voltage circuit breakers because it has excellent electrical properties such as very high dielectric strength, especially when pressurized, high arc quenching ability, and inertness. These electrical properties make SF6 gas an excellent insulating medium. However, SF6 gas is also an extremely potent greenhouse gas. According to the Greenhouse Gas Protocol, a standard entity that measures and manages greenhouse gas emissions, SF6 gas is approximately 23,000 more potent than carbon dioxide ($CO_2$) as a greenhouse gas.

Accordingly, it is desirable to provide an improved circuit breaker for high voltage applications without the use of SF6 gas and without increasing the size of the dead tank.

SUMMARY

Disclosed are example embodiments of a circuit breaker and components of a circuit breaker. In one example embodiment, a circuit breaker is disclosed. The circuit breaker can include: a grounded vessel having a pressurized gas; a plurality of vacuum interrupters coupled in series; a current bypass assembly coupled in parallel to the plurality of the vacuum bottles; and a controller configured to actuate the moveable electrode to engage or disengage with the fixed electrodes of the current bypass assembly and to actuate the plurality of vacuum interrupters to an open or closed position. The current bypass assembly can include a moveable electrode and a fixed electrode, where the current bypass assembly and the plurality of vacuum bottles are disposed within the grounded vessel.

The controller is configured to close a circuit path of the circuit breaker by first actuating the moveable electrode to engage the fixed electrode of the current bypass assembly before actuating the plurality of vacuum interrupters to a closed position. The controller is also configured to open the circuit path of the circuit breaker by first actuating the moveable electrode to disengage from the fixed electrode of the current bypass assembly before actuating the plurality of vacuum interrupters to an open position.

In the above circuit breaker, the plurality of vacuum interrupters can be two or more vacuum interrupters. In some embodiments, a dampening resistor can be coupled in series with the plurality of vacuum bottles and in parallel with the current bypass.

The moveable electrode can be a cylindrical electrode having a lumen to receive the fixed electrode. The distal opening of the cylindrical electrode can be rounded or tapered to facilitate the reception of the fixed electrode and to reduce the risk of arcing.

The cylindrical electrode can include a wall having a first thickness and a contact portion having a second thickness. The contact portion can make direct contact with the longitudinal surface of the corresponding fixed electrode. The second thickness can be larger than the first thickness.

In some embodiments, the contact portion can include a flat surface to increase the contact surface area with the longitudinal surface of the corresponding fixed electrode. The longitudinal surface of the corresponding fixed electrode can also be flat.

The pressurized gas in the grounded vessel can be a non-SF6 gas such as, but not limited to, dry air.

Also disclosed is a dead tank system for protecting electrical components against electrical surges, the system can include: one or more vacuum interrupters; a current bypass circuit electrically coupled to the one or more vacuum interrupters; a dead tank encasing and hermetically sealing the one or more vacuum interrupters and the current bypass circuit, wherein the dead tank is pressurized with a non-SF6 gas; and a controllable mechanism coupled to the one or more vacuum interrupters and to the current bypass circuit. The controllable mechanism is configured to actuate the one or more vacuum interrupters and the current bypass circuit to open or close a main circuit path such that any pre-strike arcing occurs on the current bypass circuit.

The one or more vacuum interrupters can be coupled in series. The current bypass circuit can be coupled in parallel with the one or more vacuum interrupters.

The controllable mechanism can be configured to close the main circuit path by actuating the current bypass circuit to a closed position to allow any pre-strike arcing to occur at the current bypass circuit before closing a circuit path in the one or more vacuum interrupters.

The controllable mechanism can be configured to open the main circuit path of the circuit breaker by first actuating the current bypass circuit to an open position before actuating the one or more vacuum interrupters to an open position.

The bypass circuit can include a moveable electrode having a cylindrical electrode, which can have a lumen to receive the fixed electrode.

Also disclosed is a vacuum cartridge that can include a fixed electrode affixed at a first end of the vacuum cartridge; and a moveable electrode slideably coupled to a second end of the vacuum cartridge. The moveable electrode configured to slide over the fixed electrode and make contact along a longitudinal surface of the fixed electrode. The fixed and the moveable electrodes are configured to be electrically coupled to external conductors.

In some embodiments, the moveable electrode comprises a cylindrical electrode having a lumen configured to receive the fixed electrode. The distal opening of the cylindrical electrode, where the fixed electrode is received, can be rounded or gradually tapered.

The cylindrical electrode can have a first wall thickness and a contact portion with a second wall thickness. The second wall thickness is larger than the first thickness. Alternatively, they can be the same. The contact portion of the cylindrical electrode is configured to make direct contact with the longitudinal surface of the fixed electrode. The inner surface of the contact portion can be shaped to match the shape of the longitudinal surface. For example, the longitudinal surface can be an outer surface of a cylindrical rod The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes and may not have been selected to delineate or circumscribe the disclosed subject matter.

BRIEF DESCRIPTION OF THE DRAWINGS

The foregoing summary, as well as the following detailed description, is better understood when read in conjunction with the accompanying drawings. The accompanying drawings, which are incorporated herein and form part of the specification, illustrate a plurality of embodiments and, together with the description, further serve to explain the principles involved and to enable a person skilled in the relevant art(s) to make and use the disclosed technologies.

The figures and the following description describe certain embodiments by way of illustration only. One skilled in the art will readily recognize from the following description that alternative embodiments of the structures and methods illustrated herein may be employed without departing from the principles described herein. Reference will now be made in detail to several embodiments, examples of which are illustrated in the accompanying figures. It is noted that wherever practicable similar or like reference numbers may be used in the figures to indicate similar or like functionality.

DETAILED DESCRIPTION

Vacuum interrupters are very good at interrupting current by pulling away the electrodes to stop current flow. However, vacuum interrupters do not perform well in a reverse operation to bring two electrodes together to initiate current flow. This is particularly true for high voltage and current applications. In a vacuum interrupter, the electrical field between the opposing electrodes or conductors begins to build up as the gap between the electrodes narrows. At a certain gap distance, the electrical field is so strong such that the dielectric strength of the (imperfect) vacuum between the gap breaks down. At this moment, in high voltage applications, very high inrush current can flow through the vacuum arc. Over time, pre-arcing events can substantially damage the electrodes and/or the vacuum interrupter. For example, the pre-arcing energy can be so strong that contact welding of the electrodes can occur, which can lead to catastrophic failure of the circuit breaker as the current interruption process failed due to welded electrodes.

Figure 1:
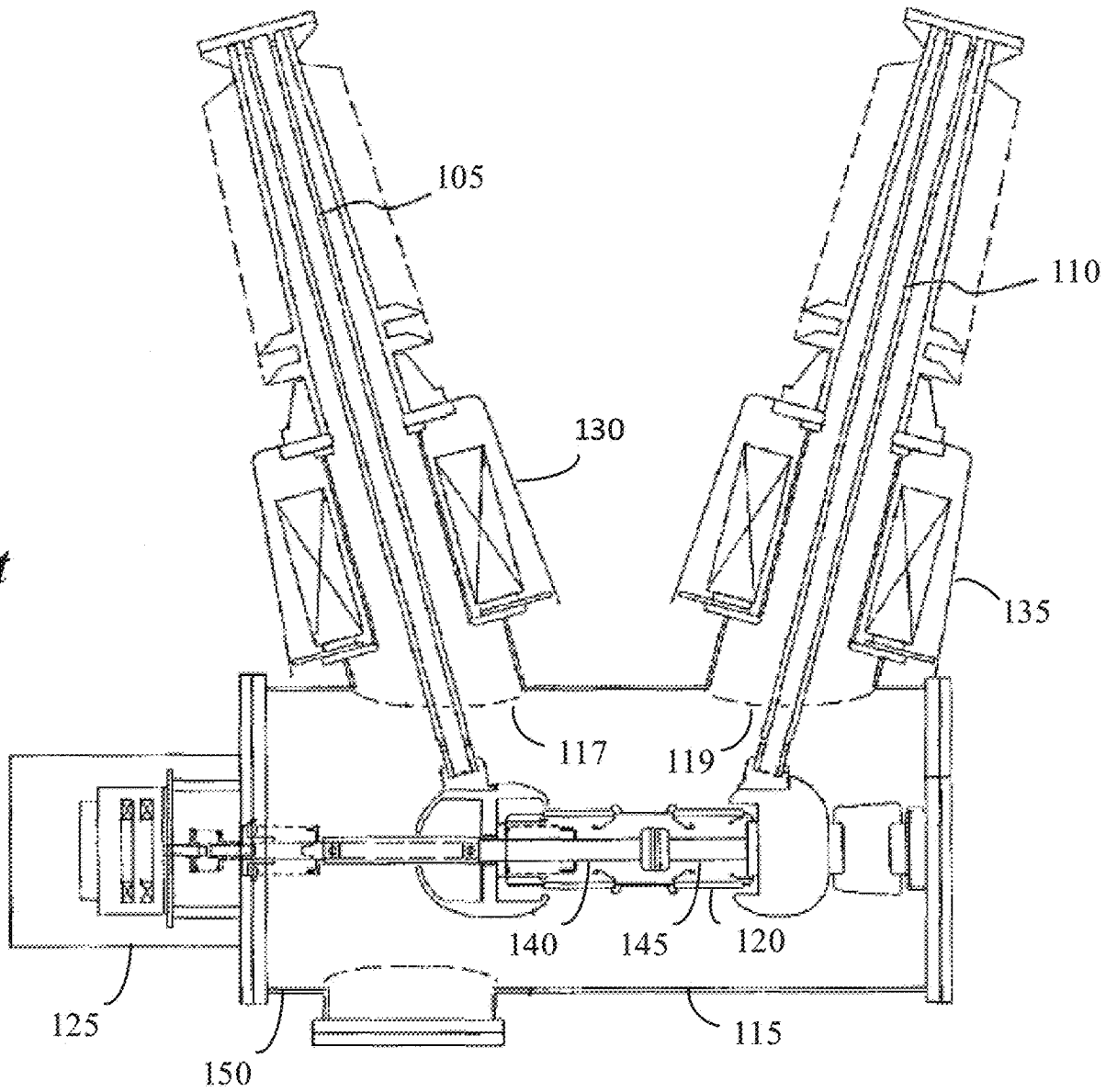
FIG. 1 Prior Art
FIG. 1 illustrates a conventional dead tank circuit breaker.

FIG. 1 is a cross section of a conventional dead tank vacuum circuit breaker 100, which includes main conducting rods 105 and 110, dead tank 115, vacuum interrupter 120, and actuating mechanism 125. Dead tank 115 is electrically grounded and is typically installed in a horizontal position well above ground level. Dead tank 115 includes a pair of openings 117 and 119 to receive main conducting rods 105 and 110, which carry current from and to the main grid. Some dead tank systems also include current transformers 130 and 135, which are disposed around openings 117 and 119. Dead tank 110 can be hermetically sealed and filled with a dielectric gas such as sulfur hexafluoride (SF6). The size (e.g., diameter and length) of dead tank 110 can be made larger to increase the dielectric withstand of circuit breaker 100. As shown, vacuum interrupter 120 includes electrodes 140 and 145, one of which is moveable in order to engage or disengage to the electrodes. As shown, electrodes 140 and 145 are engaged and thereby passing current from conducting rod 105 to conducting rod 110.

Vacuum interrupter 120 is centrally positioned within dead tank 115. This is to increase the distance between outer wall 150 and electrodes 140 and 145. Vacuum interrupter 120 is vacuum sealed to provide the highest possible dielectric strength within the vacuum bottle. As shown in FIG. 1, circuit breaker 100 only has one current path, which is defined by the path starting from conducting rod 105, to electrodes 140 and 145, and finally out at conducting rod 110. In operation, from the open position, there exists a space (not shown) between electrodes 140 and 145. This space provides the current interruption. As the circuit is closed from the open position, electrode 140 is actuated to engage electrode 145 (which is fixed). In high voltage scenarios, current arcing will likely occur as the electric field builds up when the gap between the electrodes narrows. Eventually, the electric field becomes so strong that it starts to break down the dielectric strength of the vacuum within vacuum bottle 120. Once this occurs, current arcing between the electrodes happens. The arcing effect is undesirable and likely unavoidable in circuit breaker 100 in high voltage scenarios or during an abnormal voltage surge.

Arcing caused at least by the engagement of electrodes 140 and 145 can cause substantial wear and tear on electrodes 140,145 and vacuum bottle 120. Over time, repeated arcing events can cause the vacuum bottle to entirely fail. As previously mentioned, one of the failure modes is contact welding caused by high energy arcing. Additionally, arcing can cause surface defects on the electrodes, which can generate their own errant electric field. This can facilitate more arcing to occur.

Figure 2:
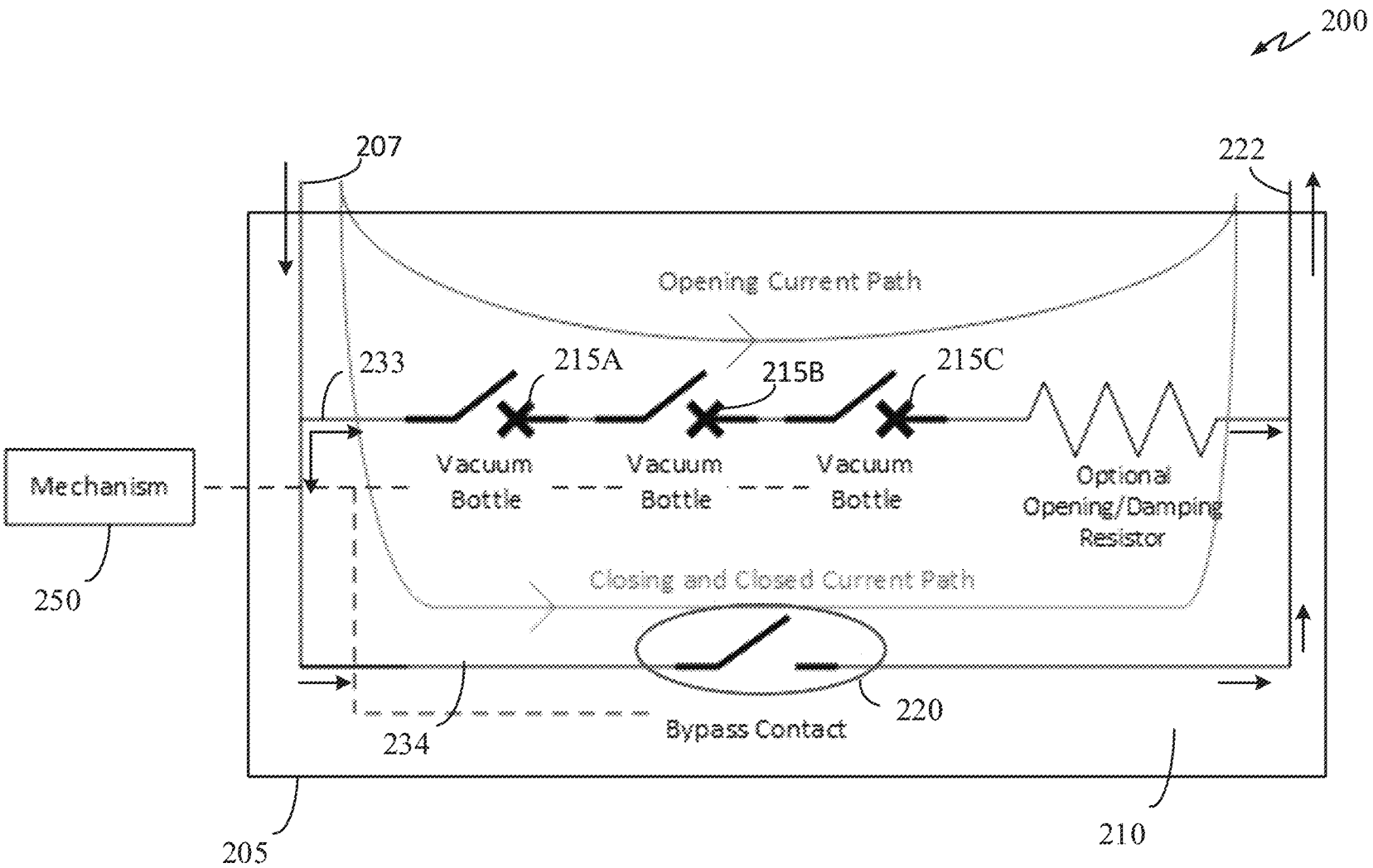
FIG. 2 illustrates a circuit breaker in accordance with some aspects of the present disclosure.

FIG. 2 illustrates a schematic of a circuit breaker 200 in accordance with some embodiments of the present disclosure. Circuit breaker 200 includes a sealed tank 205 filled with a dielectric medium 210. Sealed tank 205 fully envelops a plurality of vacuum interrupters 215A, 215B, and 215C, and a bypass circuit assembly 220. Each vacuum interrupters 215A, 215B, and 215C, can be coupled in series with each other. Bypass circuit assembly 220 can be coupled parallel to the plurality of vacuum interrupters 215A, 215B, and 215C. In this configuration, large current coming from incoming conductor line 207 is split into two separate paths 233, 234. The first path, 233, is through the plurality of vacuum interrupters 215A, 215B, and 215C, and the second path, 234, is through the bypass circuit assembly 220. When the plurality of vacuum interrupters 215A, 215B, and 215C, and bypass circuit assembly 220 are closed, current flows freely in both paths 233, 234 to outgoing conductor line 222.

Circuit breaker 200 can also include damping resistor 240 coupled in series with the last vacuum interrupter in the series of vacuum interrupters. Although circuit breaker 200 is shown to have 3 vacuum interrupters, circuit breaker 200 can have any number of vacuum interrupter such as 1, 2, or 5.

Each vacuum interrupter 215 includes a moveable electrode (not shown) and a fixed electrode (not shown). To interrupt the current, the moveable electrode in each of the vacuum interrupters is retracted to disengage from the fixed electrode and thereby interrupting the current flow. Depending upon the system voltage, one or more vacuum interrupters can be coupled together in series to increase the system's ability to handle a higher voltage.

Actuation mechanism and controller ("actuation assembly") 250 includes both mechanical and electrical components to control the moveable electrode in each vacuum interrupter. Actuation assembly 250 is also coupled to bypass circuit assembly 220. Actuation assembly 250 is configured to control and actuate bypass circuit assembly 220 to open and close the bypass contact, which can be a lever type switch, or a piston-like switch similar to the switching mechanism (e.g., moveable electrode) in a vacuum interrupter. In some embodiments, bypass circuit assembly 220 includes a moveable conductor and a fixed conductor (see FIGS. 3A-3B below). Bypass circuit assembly 200 can also include mechanical and electrical components (not shown) coupled to actuation assembly 250 that enable the control and actuation of the switch mechanism (e.g., moveable conductor) of bypass circuit assembly 220.

As previously mentioned, the plurality of vacuum interrupters 215A, 215B, and 215C, and bypass circuit assembly 220 can be completely disposed in sealed tank 205, which can be both grounded and pressurized (e.g., pressurized dead tank). Dead tank 205 is configured to protect the plurality of vacuum interrupters 215A, 215B, 215C, and bypass circuit assembly 220 by surrounding those components in an electrically insulative medium such as, but not limited to, dry air. Other non-SF6 gases can also be used in dead tank 205. Conventionally, a dead tank has to be reasonably large (e.g., large diameter) with a thick wall. This allows for the conventional dead tank to have large dielectric withstand by providing a long distance between the wall of the tank and the vacuum interrupter's conductors while also having a pressurized SF6 gas as the insulation medium.

Dead tank 205 of circuit breaker 200 can be smaller than conventional dead tank while not using the highly potent greenhouse gas (SF6). This is made possible by providing two different circuit paths 233, 234. One current path is managed by one or more vacuum interrupters 215 and the second current path is managed by bypass circuit assembly 220. This combination allows the one or more vacuum interrupters 215 to handle a much larger current load and surge than possible without split current path and the bypass circuit assembly 220.

In operation, to interrupt the current flow from incoming conductor line 207, actuation assembly 250 is configured to disengage bypass circuit assembly 220 first. For example, actuation assembly 250 can cause the moveable electrode (not shown) of bypass circuit assembly 220 to be retracted and disengage from the fixed electrode coupled to the outgoing conductor line 222. Once the current path of bypass circuit assembly 220 is opened, the plurality of vacuum interrupters 215 will temporarily handle all of the current load. Vacuum interrupters are designed to be robust current interrupters and can briefly handle a great amount of current. Next, actuation assembly 250 can cause the moveable electrode (not shown) in each vacuum interrupter to disengage from the opposing electrode. This safely opens current path 233 and arcing is minimized because bypass circuit assembly 220 is opened first. In some embodiments, actuation assembly 250 can cause the moveable electrode in each vacuum interrupter and the moveable electrode of bypass circuit assembly 255 to open at substantially the same time.

To establish current flow in circuit breaker 200 from an open position, actuation assembly 250 can close the current path in bypass circuit assembly 220 first. The electrodes in bypass circuit assembly 220 can be designed to be more robust against current arcing. Thus, even if arcing occurs, the electrodes in bypass circuit assembly 220 can last much longer than the electrodes in each vacuum interrupter. Once the current path for bypass circuit assembly 220 is established (closed), the moveable electrode in each vacuum interrupter can be closed and arcing would be minimized because current flow has been established in path 234. In this way, arcing due to the breakdown of the dielectric strength in the vacuum interrupter is greatly minimized if not eliminated.

Figure 3A:
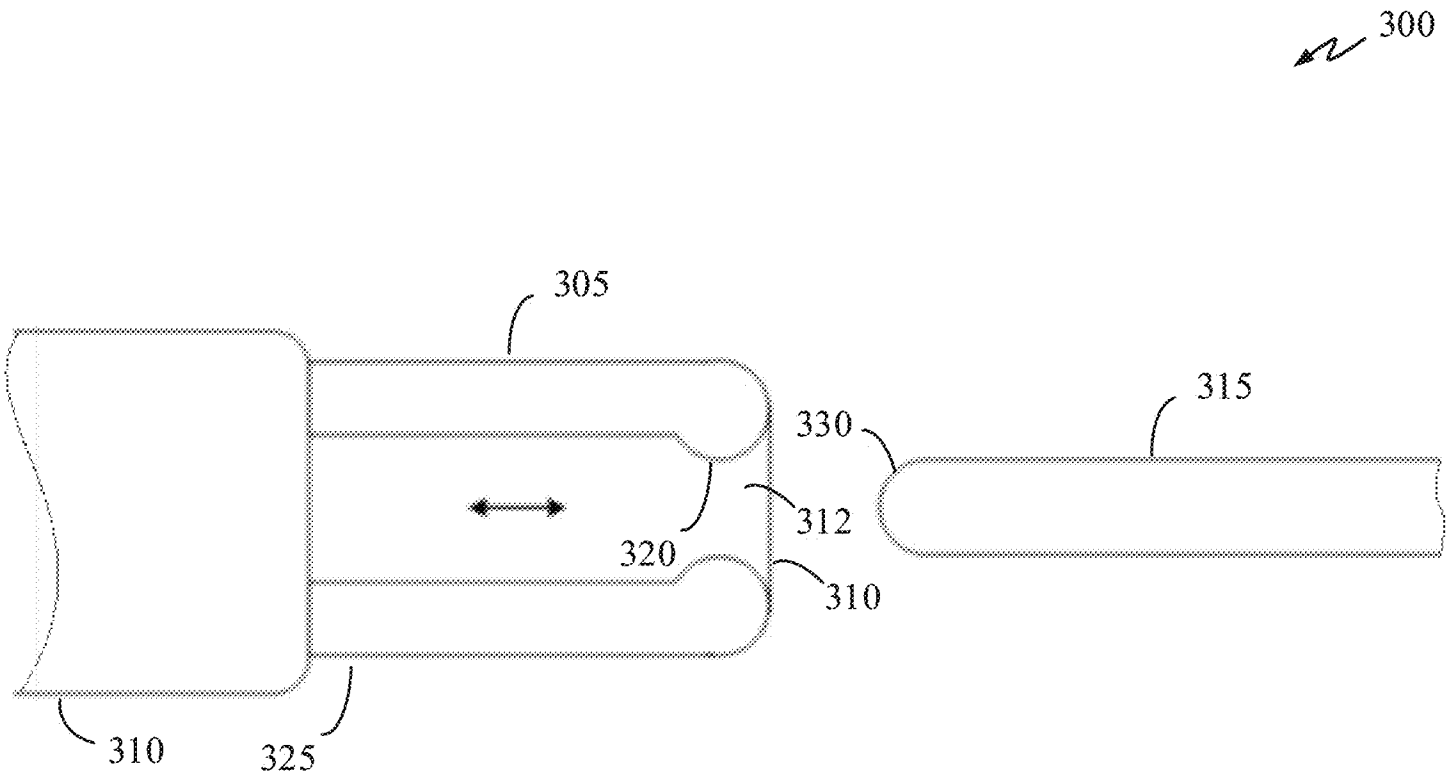
FIG. 3A illustrates the electrodes of the bypass circuit assembly in an open position in accordance with some aspects of the present disclosure.

FIG. 3A illustrates bypass circuit assembly 300 in an open position in accordance with some embodiments of the present disclosure. Bypass circuit assembly 300 includes a moveable electrode 305, which can be actuated by actuation mechanism 310 (and can also be controlled by actuation assembly 250). Moveable electrode 305 can have a cylindrical shape with an opening 310.

Opening 310 can partially or fully run the length of cylindrical electrode 305. In some embodiments, opening 310 can have a shape that corresponds with the shape of fixed electrode 315. In this way, when cylindrical electrode 305 is translated onto fixed electrode 315, the inner surface of cylindrical electrode 305 would substantially match and mate with the outer surface of fixed electrode 315. In other words, opening 310 and fixed electrode 315 can be shaped to have a female-male fit. It should be noted that fixed electrode 315 can also be a moveable electrode.

The distal opening 312 of cylindrical electrode 305 can be rounded or tapered to better receive and guide in fixed electrode 315. Cylindrical electrode 305 can also have a contact portion 320 that is larger than the proximal portion 325 of cylindrical electrode 305. Contact portion 320 can be rounded or tapered to enable better reception of fixed electrode 315. Distal tip 330 of fixed electrode 315 can also be rounded to minimize sharp edges as they can contribute to the instability of the electric field.

Based on computer simulations of surge withstand capability, the shapes of cylindrical-shaped electrode 305 and the corresponding fixed electrode 315 yields a very high surge withstand capability as compared to conventional switches having two perpendicular (with respect to the axis of the electrode) contact surfaces. This is particularly evidence when fixed electrode 315 is inserted into cylindrical electrode 305.

Figure 3B:
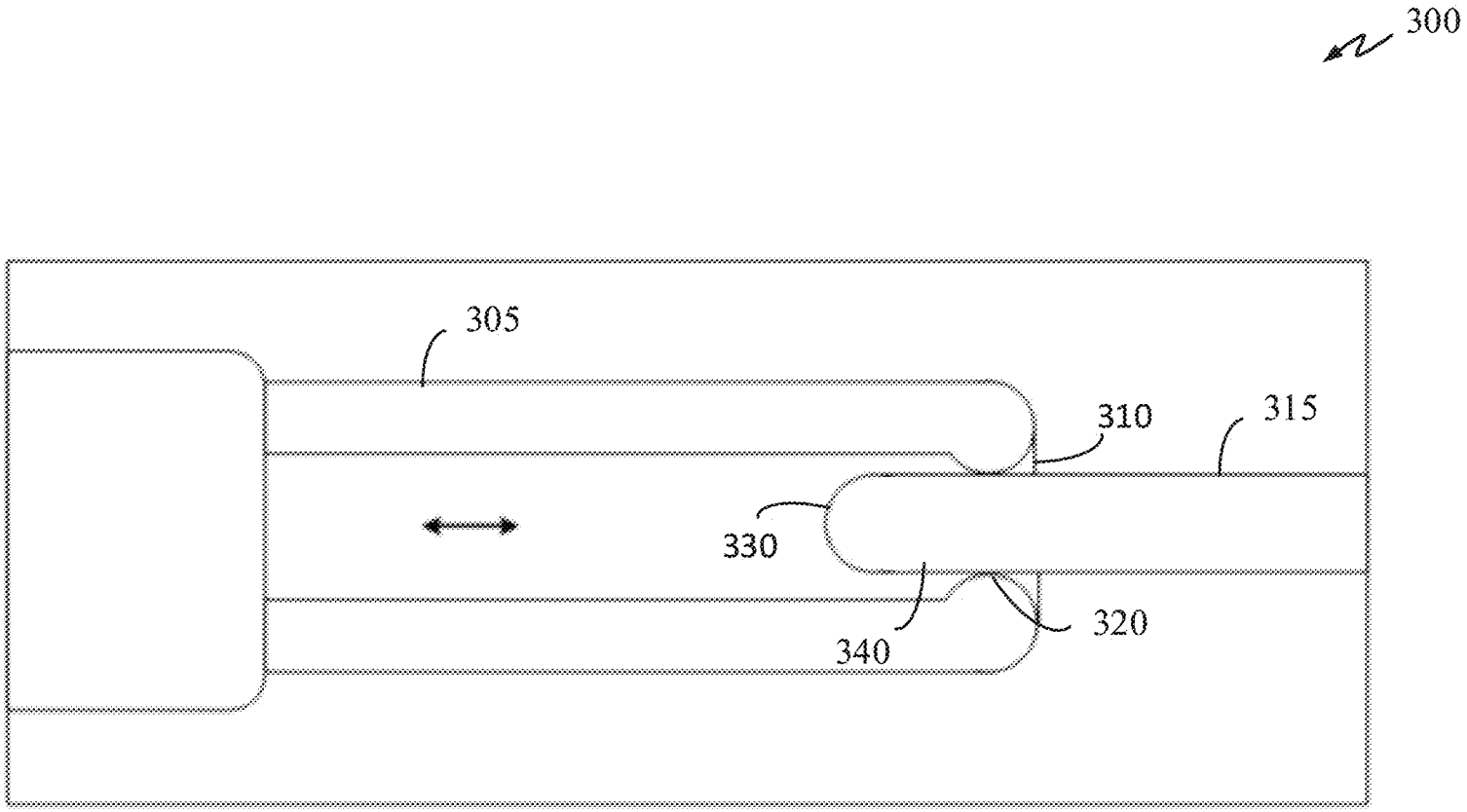
FIGS. 3B, 3C, and 3D illustrate the electrodes of the bypass circuit assembly in a closed position in accordance with some aspects of the present disclosure.
Figure 3C:
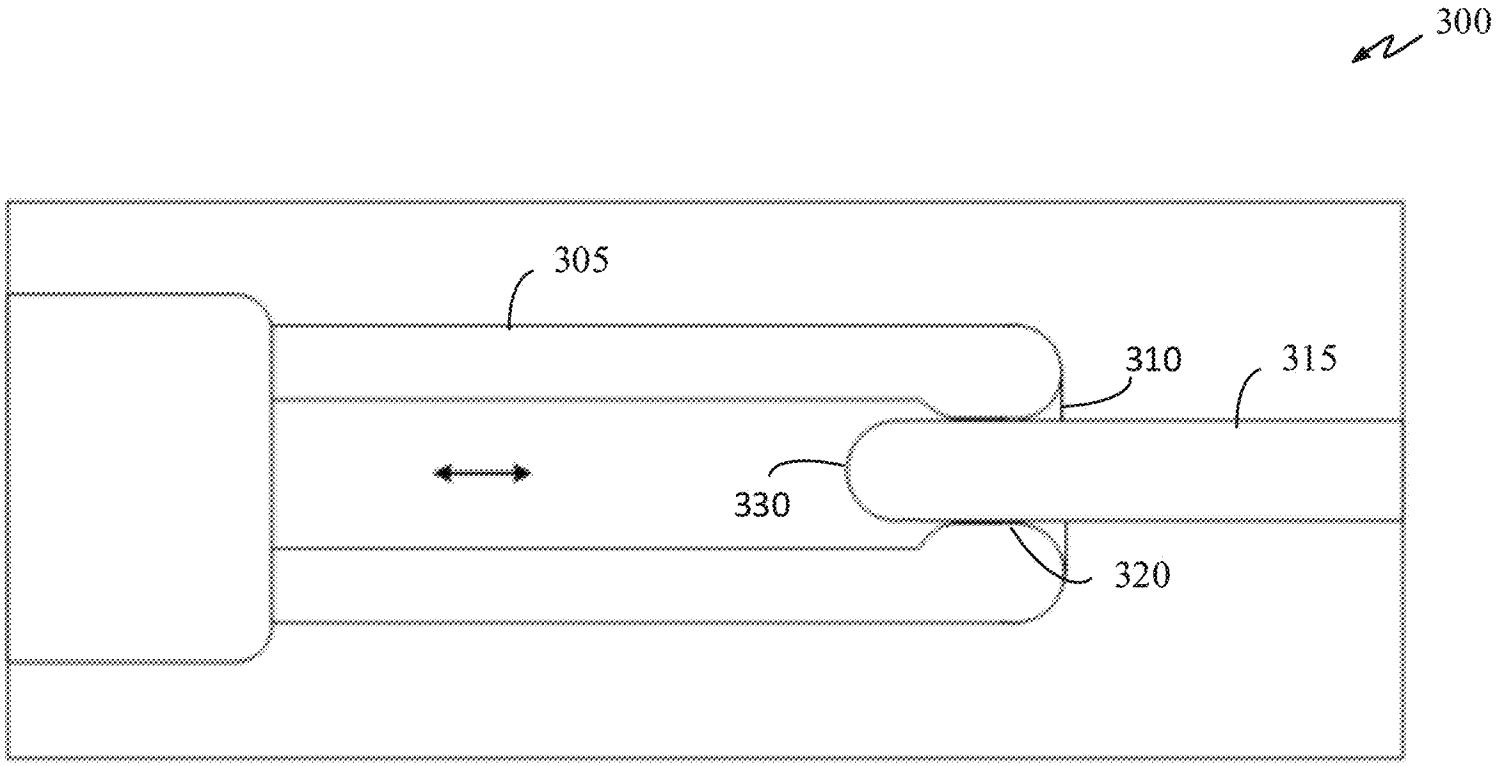

FIG. 3B illustrates bypass circuit assembly 300 in a closed position in accordance with some embodiments of the present disclosure. As shown, a distal portion 340 of fixed electrode 315 is surrounded by cylindrical electrode 305. Contact between cylindrical electrode 305 and distal portion 340 can occur at contact portion 320, which can be a flattened surface as show in FIG. 3C.

Figure 3D:
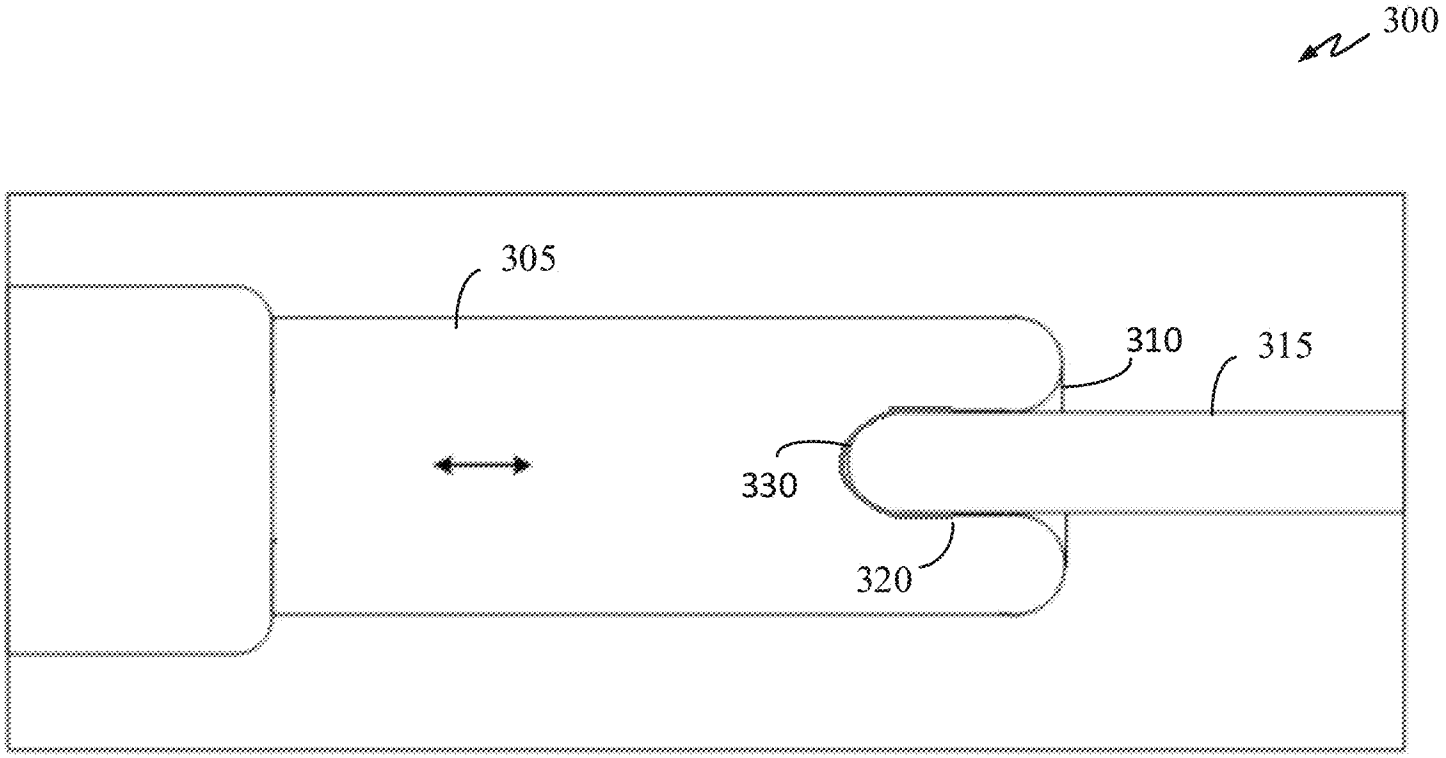

FIG. 3D illustrates bypass circuit assembly 300 in a closed position in accordance with some embodiments of the present disclosure. As shown, cylindrical electrode 305 is shaped to substantially match the shape of fixed electrode 315. Fixed electrode can have a circular cross-section. In some embodiments, fixed electrode 315 can have other shapes such as, but not limited to, a polygonal cross-section (e.g., a square, trapezoid).

Additionally, conventional contact surfaces of electrodes in a vacuum interrupter are flat as shown in FIG. 1. The piston like moveable electrode is pushed to engage the flat surface of the fixed electrode. However, this shape may not be ideal to reduce arcing. Thus, in some embodiments, the electrodes of vacuum interrupters 215A, 215B, 215C have the same shapes as the electrodes in bypass circuit assembly 220.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Some portions of the following detailed description are presented in terms of algorithms and symbolic representations of operations on data bits within a computer memory. These algorithmic descriptions and representations are the methods used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared or otherwise manipulated. It has proven convenient at times, principally for reasons of common usage, to refer to these signals as bits, values, elements, symbols, characters, terms, numbers or the like.

The figures and the following description describe certain embodiments by way of illustration only. One skilled in the art will readily recognize from the following description that alternative embodiments of the structures and methods illustrated herein may be employed without departing from the principles described herein. Reference will now be made in detail to several embodiments, examples of which are illustrated in the accompanying figures. It is noted that wherever practicable similar or like reference numbers may be used in the figures to indicate similar or like functionality.

The foregoing description of the embodiments of the present invention has been presented for the purposes of illustration and description. It is not intended to be exhaustive or to limit the present invention to the precise form disclosed. Many modifications and variations are possible in light of the above teaching. It is intended that the scope of the present invention be limited not by this detailed description, but rather by the claims of this application. As will be understood by those familiar with the art, the present invention may be embodied in other specific forms without departing from the spirit or essential characteristics thereof. Likewise, the particular naming and division of the modules, routines, features, attributes, methodologies and other aspects are not mandatory or significant, and the mechanisms that implement the present invention or its features may have different names, divisions and/or formats.

The invention claimed is:

1. A circuit breaker comprising:

a grounded vessel having a pressurized gas;

a plurality of vacuum interrupters coupled in series;

a current bypass assembly coupled in parallel to the plurality of the vacuum interrupters, wherein the current bypass assembly comprises a moveable electrode and a fixed electrode, and wherein the current bypass assembly and the plurality of vacuum interrupters are disposed within the grounded vessel; and a controller configured to actuate the moveable electrode to engage or disengage with the fixed electrode of the current bypass assembly and to actuate the plurality of vacuum interrupters to an open or closed position.

2. The circuit breaker of claim 1, wherein the controller is configured to close a circuit path of the circuit breaker by first actuating the moveable electrode to engage the fixed electrode of the current bypass assembly and then actuating the plurality of vacuum interrupters to the closed position after the current bypass assembly is in a closed position.

3. The circuit breaker of claim 2, wherein the controller is configured to open the circuit path of the circuit breaker by first actuating the moveable electrode to disengage from the fixed electrode of the current bypass assembly and then actuating the plurality of vacuum interrupters to the open position after the current bypass assembly is in an open position.

4. The circuit breaker of claim 1, wherein the plurality of vacuum interrupters comprises three or more vacuum bottles.

5. The circuit breaker of claim 1, further comprising a dampening resistor coupled in series with the plurality of vacuum interrupters and in parallel with the current bypass.

6. The circuit breaker of claim 1, wherein the moveable electrode comprises a cylindrical electrode having a lumen to receive the fixed electrode.

7. The circuit breaker of claim 6, wherein a distal opening of the cylindrical electrode is rounded or tapered.

8. The circuit breaker of claim 6, wherein the cylindrical electrode comprises a wall having a first thickness and a contact portion having a second thickness, wherein the contact portion is configured to make direct contact with a longitudinal surface of the fixed electrode, wherein the second thickness is larger than the first thickness.

9. The circuit breaker of claim 8, wherein the contact portion comprises a flattened surface to increase a contact surface area with the longitudinal surface of the fixed electrode, wherein the longitudinal surface of the fixed electrode is flat.

10. The circuit breaker of claim 1, wherein the pressurized gas is a non-SF6 gas.

11. A dead tank system for protecting electrical components against electrical surges, the system comprising:

a plurality vacuum interrupters;

a current bypass circuit electrically coupled to one or more vacuum interrupters;

a dead tank encasing and hermetically sealing the one or more vacuum interrupters and the current bypass circuit, wherein the dead tank is pressurized with a non-SF6 gas; and a controllable mechanism coupled to the one or more vacuum interrupters and to the current bypass circuit, the controllable mechanism is configured to actuate the one or more vacuum interrupters and the current bypass circuit to open or close a main circuit path such that any pre-strike arcing occurs on the current bypass circuit;

wherein the one or more vacuum interrupters are coupled in series, and wherein the current bypass circuit is coupled in parallel with the one or more vacuum interrupters.

12. A dead tank system for protecting electrical components against electrical surges, the system comprising:

one or more vacuum interrupters;

a current bypass circuit electrically coupled to the one or more vacuum interrupters;

a dead tank encasing and hermetically sealing the one or more vacuum interrupters and the current bypass circuit, wherein the dead tank is pressurized with a non-SF6 gas;

a controllable mechanism coupled to the one or more vacuum interrupters and to the current bypass circuit, the controllable mechanism is configured to actuate the one or more vacuum interrupters and the current bypass circuit to open or close a main circuit path such that any pre-strike arcing occurs on the current bypass circuit; and a dampening resistor coupled in series with the one or more vacuum interrupters and in parallel with the current bypass circuit.

13. A dead tank system for protecting electrical components against electrical surges, the system comprising:

one or more vacuum interrupters;

a current bypass circuit electrically coupled to the one or more vacuum interrupters;

a dead tank encasing and hermetically sealing the one or more vacuum interrupters and the current bypass circuit, wherein the dead tank is pressurized with a non-SF6 gas; and a controllable mechanism coupled to the one or more vacuum interrupters and to the current bypass circuit, the controllable mechanism is configured to actuate the one or more vacuum interrupters and the current bypass circuit to open or close a main circuit path such that any pre-strike arcing occurs on the current bypass circuit;

wherein the current bypass circuit comprises a cylindrical moveable electrode having a lumen to receive the fixed electrode; wherein a distal opening of the cylindrical moveable electrode is rounded or tapered.

14. The dead tank system of claim 13, wherein the cylindrical electrode comprises a wall having a first thickness and a contact portion having a second thickness, wherein the contact portion is configured to make direct contact with a longitudinal surface of the fixed electrode, wherein the second thickness is larger than the first thickness.

15. The dead tank system of claim 14, wherein the contact portion comprises a flattened surface to increase a contact surface area with the longitudinal surface of the fixed electrode, wherein the longitudinal surface of the fixed electrode is flat.

* * * * *